US007750867B2

(12) United States Patent
Nakajima et al.

(10) Patent No.: US 7,750,867 B2
(45) Date of Patent: Jul. 6, 2010

(54) SMART ANTENNA AND ANTENNA FIXING MECHANISM

(75) Inventors: Nobuo Nakajima, Tokyo (JP); Koichi Gyoda, Tokyo (JP); Eiji Shibuya, Kobe (JP); Takehiro Onomatsu, Osaka (JP); Hideto Yoshimura, Osaka (JP)

(73) Assignees: Funai Electric Co., Ltd., Daito-shi, Osaka (JP); The University of Electro-Communications, Choufu-shi, Tokyo (JP)

( * ) Notice: Subject to any disclaimer, the term of this patent is extended or adjusted under 35 U.S.C. 154(b) by 77 days.

(21) Appl. No.: 12/151,226

(22) Filed: May 5, 2008

(65) Prior Publication Data

US 2008/0278399 A1 Nov. 13, 2008

(30) Foreign Application Priority Data

May 8, 2007 (JP) ..... 2007-123455

(51) Int. Cl.
*H01Q 1/42* (2006.01)

(52) U.S. Cl. ..... 343/872; 343/873; 343/878

(58) Field of Classification Search ..... 343/872, 343/873, 878, 705, 709, 713, 892, 795; 248/534
See application file for complete search history.

(56) References Cited

U.S. PATENT DOCUMENTS 4,595,165 A * 6/1986 Klingensmith et al. ..... 248/539
5,604,508 A * 2/1997 Atkinson ..... 343/879
6,175,339 B1 * 1/2001 Macon ..... 343/892

FOREIGN PATENT DOCUMENTS

JP 06-009210 U 2/1994
JP 07-154122 6/1995

* cited by examiner

*Primary Examiner*—Michael C Wimer
*Assistant Examiner*—Kyana R Robinson
(74) *Attorney, Agent, or Firm*—Yokoi & Co., U.S.A., Inc.; Toshiyuki Yokoi

(57) ABSTRACT

A holding part 50 fixedly holds a shaft 17 included in a smart antenna 10 on a television receiver 20. The smart antenna 10 is held fixedly by the holding part 50. The shaft 17 of the smart antenna 10 is provided with an opening 17*a* in a part thereof distant from a part thereof held by the holding part 50. A wiring 15*a* is extended outside from the shaft 17 through the opening 17*a* and is connected to the television receiver 20.

6 Claims, 7 Drawing Sheets

SMART ANTENNA AND ANTENNA FIXING MECHANISM

CROSS-REFERENCES TO RELATED APPLICATIONS

The present application is related to the Japanese Patent Application No. 2007-123455, filed May 8, 2007, the entire disclosure of which is expressly incorporated by reference herein.

BACKGROUND OF THE INVENTION (1) Field of the Invention

The present invention relates to a smart antenna and, more particularly, to a smart antenna including a receiving element to be held above a television receiver.

(2) Description of Related Art

When a television viewer adjusts the direction of an antenna by a known antenna adjusting method, the television viewer adjusts the direction of an antenna making reference to an image displayed on the screen of a television receiver to an optimum receiving direction for receiving broadcast television signals. However, this known antenna adjusting method is very troublesome. Some antenna system includes a receiving condition indicator, and an antenna whose direction can be manually adjusted making reference to a receiving condition indicated by the receiving condition indicator. Another known antenna system includes an antenna whose direction can be automatically adjusted in response to a request made by the television viewer.

A previously proposed antenna system includes an antenna whose directivity can be automatically changed every time a desired channel is selected. Generally, such an antenna is called "smart antenna." Referring to FIG. 7 showing a known smart antenna 1 in a perspective view, the smart antenna 1 includes an antenna unit 2 provided with a receiving element, a housing 3 holding the antenna unit 2 therein, a support rod holding the housing 3 at a predetermined height and fastened to a television receiving system 6, and a wiring 5 electrically connecting the antenna unit 2 to the television receiving system 6. The television receiving system 6 controls the smart antenna 1 through the wiring 5 on the basis of predetermined standards to change the receiving directivity of the smart antenna 1.

When the smart antenna 1 is connected to the television receiver 6, the receiving element 2 needs to be set substantially horizontally when the television receiver 6 is installed on a horizontal surface at a predetermined distance from the television receiver 6 to ensure that the antenna element exercise a high receiving sensitivity. Generally, a room antenna has an antenna element, namely, a receiving element for receiving broadcast television signals, capable of being extended to raise its receiving sensitivity. In the smart antenna, the receiving element is extended horizontally so that the directivity can be changed. Therefore, the housing 3 holding the receiving element therein needs to be set at a predetermined distance from the television receiver 6.

The smart antenna 1 has the following problems. The wiring 5 electrically connecting the antenna unit 2 to the television receiver 6 spoils the aesthetic appearance and is broken often. As shown in FIG. 7, the wiring 5 is extended from the housing 3 set above the television receiver 6 and is connected to the television receiver 6 set below the housing 3. Therefore, the wiring 5 is conspicuous and spoils the aesthetic appearance of the television receiver 6. Moreover, the wiring 5 extended from the housing 3 breaks if the wiring 5 is caught by an obstacle.

A wiring laying method is disclosed previously in, for example, JP-U H6-9210. In a CS/BS antenna for receiving CS/BS broadcast signals, a cable connected to a BS converter and a driver is extended through a support arm supporting a parabola unit. Thus the appearance of the CS/BS antenna can be improved by concealing the wiring from view.

Another wiring laying method disclosed in, for example, JP-A H7-154122 extends a coaxial cable connecting an antenna and a satellite through a round waveguide serving also as a support pipe, and connects an end part of the coaxial cable extending outside from the lower end of the waveguide to the satellite.

The following problems arise when the inventions disclosed in JP-U H6-9210 and JP-A H7-154122 are applied to a smart antenna. As mentioned above, the receiving element of a smart antenna is set above a television receiver to receive television signals in a high sensitivity. Therefore a wiring is extended down from a position above the television receiver. The smart antenna is highly sensitive to signals owing to its own properties and, in some housings, the sensitivity of the smart antenna deteriorates when a conductive matter is brought close to the antenna unit or the wiring. Thus, the ordinary wiring method, in some housings, deteriorates the sensitivity of a smart antenna.

BRIEF SUMMARY OF THE INVENTION

The present invention has been made in view of the foregoing problems and it is therefore an object of the present invention to provide a directional smart antenna including a wiring properly extended so as to provide the smart antenna with an excellent aesthetic appearance and to prevent being broken, and an antenna fixing mechanism.

A smart antenna in one aspect of the present invention having electrically changeable directivity for receiving electromagnetic wave, comprising:an antenna unit including a receiving element set to receive broadcast television signals transmitted from a plurality of directions, and that is capable of selectively providing the broadcast television signals received by the receiving element;a housing has a flat cylindrical configuration, and holds the antenna unit therein so that the receiving element is set approximately in a horizontal orientation;wiring connecting electrically the antenna unit to a television receiver; and a hollow shaft on the television receiver supporting the housing at a predetermined distance from the television receiver, and holding the wiring extended from the antenna unit in the shaft.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding parts throughout.

DETAILED DESCRIPTION OF THE INVENTION

A television receiving system including a smart antenna in a preferred embodiment according to the present invention will be described. The smart antenna of the present invention is not limited in its application to using in combination with the television receiver shown in FIG. 1 and is applicable to television receivers other than that shown in FIG. 1.

The smart antenna in the preferred embodiment will be described below in terms of the following titles.

(1) Construction of Television Receiving system (1-1) Construction of Smart Antenna (1-1-1) Construction of Housing (1-1-2) Construction of Antenna Unit (1-1-3) Shaft (1-2) Construction of Television Receiving System (1-2-1) Antenna Fixing Method (2) Conclusion (1) Construction of Television Receiving System A smart antenna in a preferred embodiment according to the present invention and a television receiver provided with the smart antenna will be described with reference to FIGS. 1 to 6. It is to be understood that the scope of the present invention is not limited by the smart antenna specifically describe herein.

Figure 1:
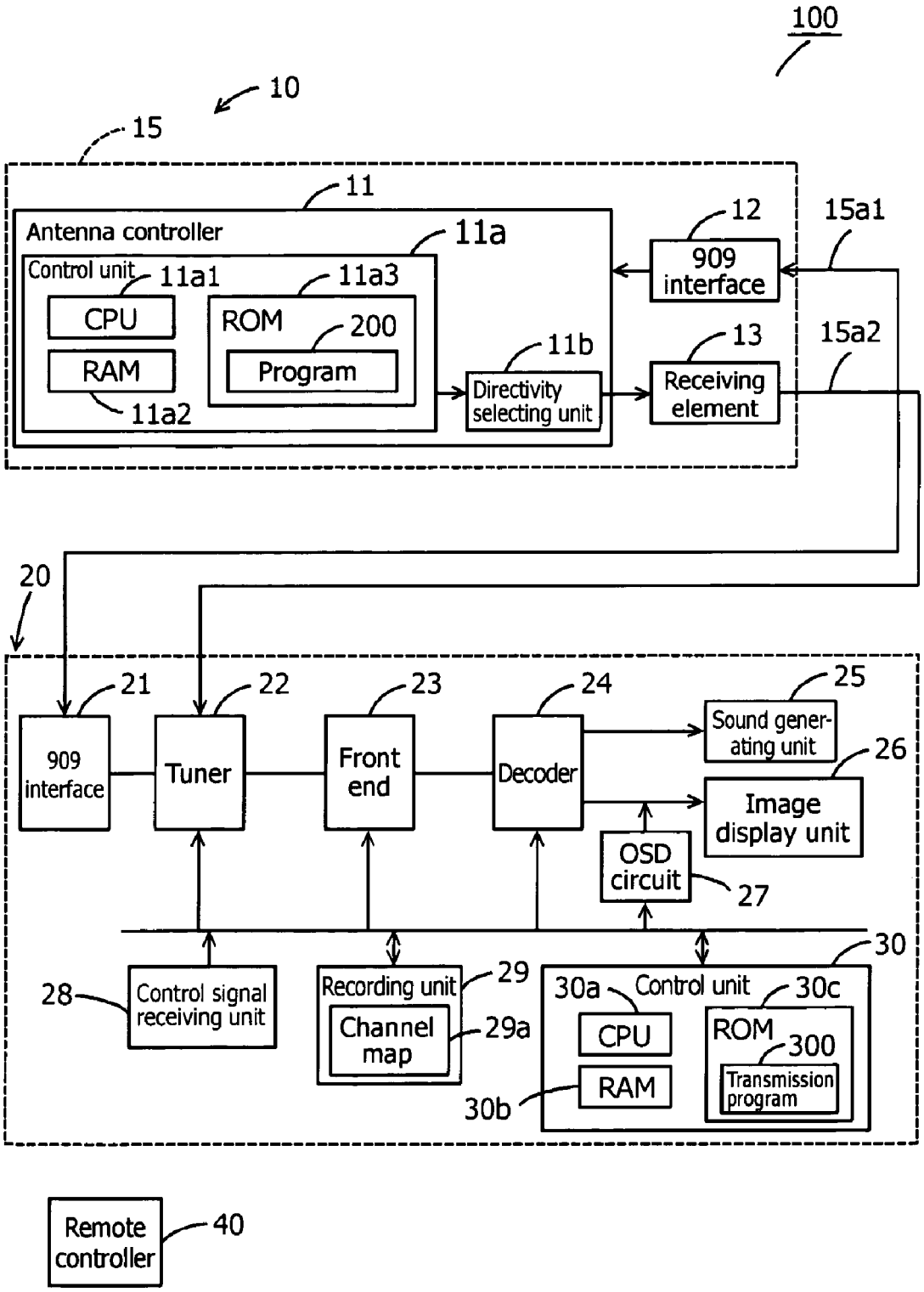
FIG. 1 is an exemplary schematic block diagram of a television receiving system.

FIG. 1 is a block diagram of a television receiving system 100 to which the present invention is applied. As shown in FIG. 1, the television receiving system 100 includes a smart antenna 10 in a preferred embodiment according to the present invention and a television receiver 20. The smart antenna 10 and the television receiver 20 are interconnected by an interface for communication in a predetermined communication system, such as EIA/CEA-909 communication system. This interface will be referred to as a 909 interface. The smart antenna 10 receives, for example, broadcast television signals. The television receiver 20 provides sounds and images represented by broadcast television signals received by the smart antenna 10.

Figure 2:
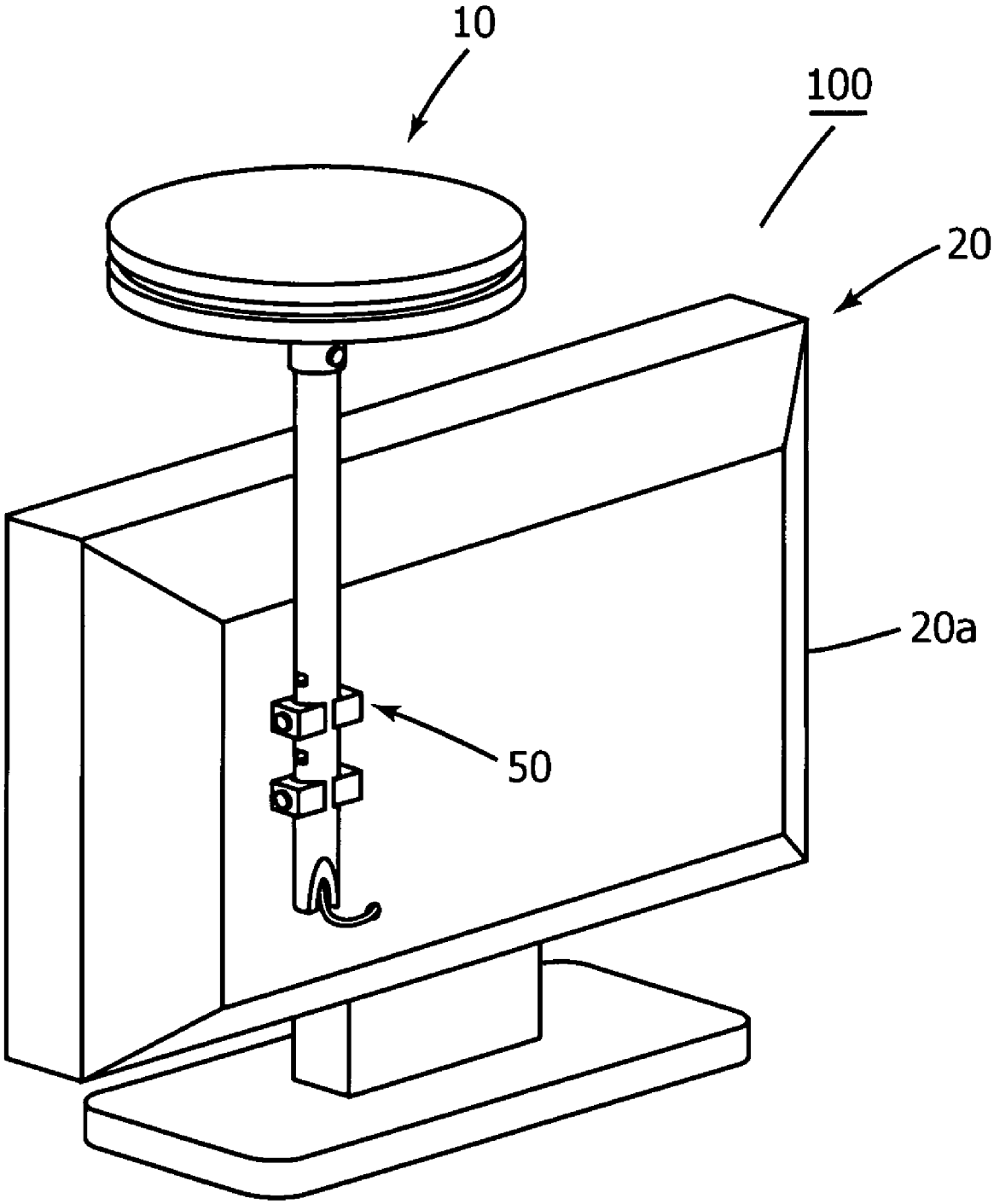
FIG. 2 is an exemplary perspective view of a smart antenna attached to a television receiver.

FIG. 2 is a perspective view of the smart antenna 10 attached to the television receiver 20. To receive broadcast television signals by the television receiving system 100, the smart antenna 10 is attached to a holding part 50 attached to the back wall of the television receiver 20, and the smart antenna 10 is connected to the television receiver 20 by a wiring. Broadcast television signals received by the smart antenna 10 are sent through the wiring to the television receiver 20.

(1-1) Construction of Smart Antenna

Figure 3:
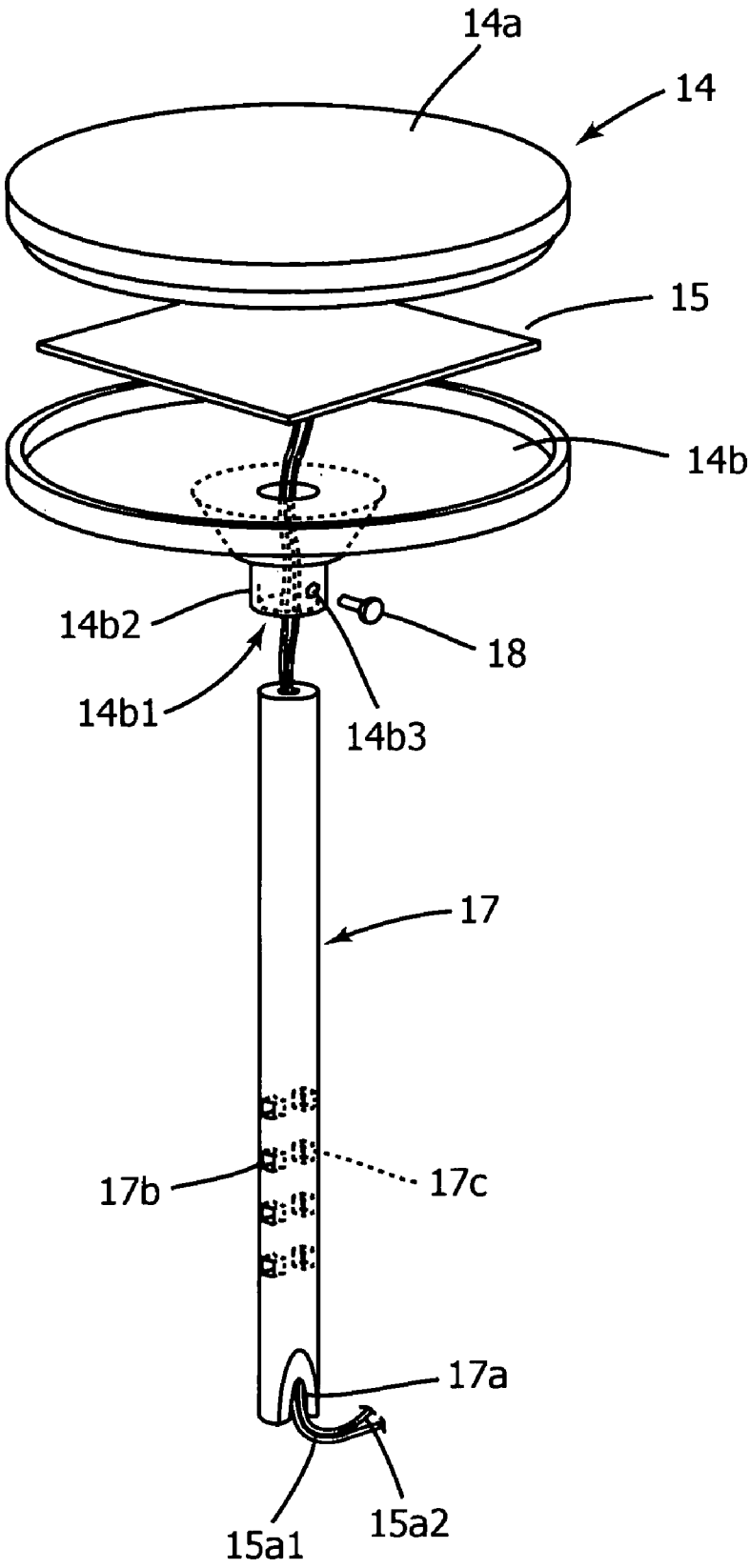
FIG. 3 is an exemplary exploded perspective view of the smart antenna.

Referring to FIG. 3 showing the smart antenna 10 in an exploded perspective view, the smart antenna 10 includes an antenna unit 15 provided with a receiving element 13, a housing 14 holding the antenna unit 15 therein, and a hollow shaft 17 having one end joined to the housing 14. The shaft 17 supports the housing 14 and the antenna unit 15 held in the housing 14 above the television receiver 20 at a predetermined distance from the television receiver 20.

(1-1-1) Construction of Housing

The housing 14 holds the antenna unit 15 therein. The antenna unit 15 includes the directional receiving element 13 for receiving broadcast television signals. The housing 14 holds the receiving element 13 such that the receiving direction of the receiving element 13 is horizontal. More concretely, a wiring board mounted with the antenna unit 15 is set in a horizontal position in the housing 14. The housing 14 includes an upper half housing 14*a* and a lower half housing 14*b* to hold the antenna unit 15 therein in a horizontal position. The housing 14 has a flat cylindrical configuration. The housing 14 is made of an insulating material to shield the antenna unit 15 from noise generated by the television receiver 20. The insulating material forming the housing 14 is, for example, a resin or a plastic material.

The upper half housing 14*a* of the housing 14 defines a space for receiving the antenna unit 15 therein and has a circular cross section. The lower half housing 14*b* defines a space for receiving the antenna unit 15 therein and has a circular cross section. The lower half housing 14*b* has a lower protrusion having the shape of an inverted frustum. A connecting member 14*b*2 provided with a bore 14*b*1 into which the shaft 17 is fixedly fitted extends down from the bottom wall of the lower half housing 14*b*. The bore 14*b*1 extends through a central part of the bottom wall of the lower half housing 14*b*. Wiring 15*a* extended from the antenna unit 15 is passed through the bore 14*b*1. The upper half housing 14*a* is joined to the lower half housing 14*b* after the wiring 15*a* has been passed through the bore 14*b*1 to seal the antenna unit 15 in the housing 14.

(1-1-2) Construction of Antenna Unit

The antenna unit 15 is capable of electrically changing the directivity of broadcast television signals. The construction of the antenna unit 15 will be described with reference to FIG. 1. The antenna unit 15 includes, for example, a 909 interface 12, an antenna controller 11, and the receiving element 13 capable of changing directivity for receiving broadcast television signals.

For example, the 909 interface 12 is connected to a 900 interface 21, which will be described later, included in the television receiver 20 by a 909 cable 15*a*1 to communicate with the 909 interface 21 of the television receiver 20 by a predetermined communication system, such as an EIA/CEA 909. The 909 interface 21 receives control information including channel information for controlling the receiving element 13 from the television receiver 20, and gives the control information to the antenna controller 11.

The antenna controller 11 is provided with, for example, a control unit 11*a*. The control unit 11*a* is provided with, for example, a CPU 11*a*1, a RAM 11*a*2, and a ROM 11*a*3. The CPU 11*a*1 executes processing programs for the antenna controller 11 stored in the ROM 11*a*3 to carry out control operations. The RAM 11*a*2 has program storage areas for storing the processing programs to be carried out by the CPU 11*a*1, and data storage areas for storing input data and data on the results of execution of the processing programs. The ROM 11*a*3 stores system programs to be executed by the antenna controller 11, processing programs specified by the system programs, data on the results of execution of those processing programs, and data obtained through arithmetic operations carried out by the CPU 11*a*1. A program 200 is expressed by computer-readable program codes. The program codes are stored in the ROM 11*a*3.

The program 200 electrically changes the directivity of the receiving element 13 on the basis of a broadcast television signal corresponding to a physical channel number contained in channel information acquired by the CPU 11*a*1. More concretely, the directivity of the receiving element 13, namely, an antenna that receives a broadcast television signal corresponding to a physical channel number contained in channel information acquired by the CPU 11*a*1 executed the program 200, on the basis of a decision of the television signal.

When the CPU 11*a*1 executed the program 200 selects the receiving element 13, for example, according to a control signal provided by the control unit 11*a*, a directivity selecting unit 11*b* changes the directivity of the receiving element 13 on the basis of direction information contained in channel information obtained by the CPU 11*a*1 executed the program 200.

The receiving element 13 is connected, for example, to a tuner 22 included in the television receiver 20 by an antenna RF cable 15*a*2. The receiving element 13 receives broadcast television signals according to an instruction provided by the CPU 11*a*1 executed the program 200. More concretely, the receiving element 13 has directivity in a plurality of directions, for example sixteen directions. When the directivity selecting unit 11*b* selects a directivity in one of the plurality of directions, the receiving element 13 has a high sensitivity to broadcast television signals in the selected direction higher than those to broadcast television signals in the other directions.

(1-1-3) Shaft

The shaft 17 supports the housing 14 holding the antenna unit 15 therein above the television receiver 20. In this embodiment, the 909 cable 15*a*1 connected to the television receiver 20, and the antenna RF cable 15*a*2 are extended through the shaft 17 when the smart antenna 10 is fixedly held on the television receiver 20. Thus the 909 cable 15*a*1 and the antenna RF cable 15*a*2 are concealed from view and hence do not spoil the aesthetic appearance of the television receiving system 100. The shaft 17 can protect the 909 cable 15*a*1 and the antenna RF cable 15*a*2 so that he 909 cable 15*a*1 and the antenna RF cable 15*a*2 may not be broken.

The shaft 17 is a round tube of a predetermined length. The shaft 17 has a lower end part having a lower open end 17*a* as a opening and provided with a plurality of grooves 17*b* and 17*c* in a longitudinal direction. The shaft 17 is made of an insulating material to shield the 909 cable 15*a*1 and the antenna RF cable 15*a*2 connected to the television receiver 20 from noise generated by the television receiver 20.

The shaft 17 is joined to the housing 14 by fitting an upper end part thereof opposite the lower end part having the lower open end 17*a* and provided with the grooves 17*b* and 17*c* in the bore 14*b*1 of the connecting member 14*b*2. The 909 cable 15*a*1 and the antenna RF cable 15*a*2 extended from the antenna unit 15 contained in the housing 14 are passed trough the bore 14*b*1, are extended through the bore of the shaft 17, and are extended through the lower open end 17*a* outside the shaft 17. The connecting member 14*b*2 is provided in its wall with an internally threaded hole 14*b*3. A screw 18 is screwed into the internally threaded hole 14*b*3 and pressed against the upper end part of the shaft 17 to hold the housing 17 fixedly on the shaft 17.

(1-2) Construction of Television Receiver

The construction of the television receiver 20 will be described with reference to FIG. 1. For example, the television receiver 20 includes the 909 interface 21, the tuner 22, a front end 23, a decoder 24, an OSD circuit 27, a control signal receiving unit 28, a recording unit 29, and a control unit 30. Those components of the television receiver 20 are set in a cabinet 20*a* made of a resin. As shown in FIG. 2, the smart antenna 10 is fixedly held by a holding part 50 attached to the back wall of the cabinet 20*a*.

The television receiver 20 receives broadcast television signals received by the smart antenna 10 and provides sounds and images. The television receiver 20 is provided with a sound generating unit 25 and an image display unit 26, which are connected to the decoder 24. The television receiver 20 includes a remote controller 40 capable of communicating with the control signal receiving unit 28. The remote controller 40 is operated to control the television receiver 20. The components of the television receiver 20 will be described.

For example, the 909 interface 21 is connected to the 909 interface 12 of the smart antenna 10 by the 909 cable 15*a*1. For example, the 909 interface 21 communicates with the 909 interface 12 of the smart antenna 10 by a predetermined communication system, such as an EIA/CEA 909, according to control signals given thereto by the control unit 30. The 909 interface 21 sends channel information and such to the smart antenna 10 to control the smart antenna 10.

For example, the tuner 22 is electrically connected to the receiving element 13 of the smart antenna 10 by the antenna RF cable 15*a*2. The tuner 22 operates according to a control signal given thereto by the control unit 30 to select broadcast television signals on a channel selected by the user from broadcast television signals provided by the receiving element 13, and sends the selected broadcast television signals to the front end 23.

For example, the front end 23 converts the broadcast television signals received from the tuner 22 into signals of an intermediate frequency according to a control signal received from the control unit 30, and gives the signals of the intermediate frequency to the decoder 24.

For example, the decoder 24 processes the broadcast television signals received from the front end 23 according to a control signal received from the control unit 30 in a predetermined file format, such as an MPEG-2 format (Moving Picture Experts Group-2 format) to divide the broadcast television signals into sound signals and image signals, and decodes the sound signals and the image signals. The decoder 24 gives the decoded sound signals to the sound generating unit 25, and gives the decoded image signals to the image display unit 26.

The sound generating unit 25 is, for example, a speaker or the like. The sound generating unit 25 generates sounds corresponding to sound data represented by the sound signals.

The image display unit 26 is, for example, a liquid crystal display or the like. The image display unit 26 displays images corresponding to image data represented by the image signals provided by the decoder 24, and images corresponding to image data represented by image signals combined with OSD display signals, which will be described later, by the OSD circuit 27

For example, the OSD circuit 27 combines an OSD display signal requesting the image display unit 26 to display images in a predetermined OSD display mode (on-screen display mode) with the image signals given to the image display unit 26 by the decoder 24.

For example, the control signal receiving unit 28 receives signals sent out by the remote controller 40 and gives data specified by the received signals to the control unit 30.

The user operates the remote controller 40 to send out desired signals to the signal receiving unit 28. More concretely, the remote controller 40 is provided with channel keys and a channel up/down key to be operated for example, to specify a desired channel.

For example, the recording unit 29 includes a magnetic recording medium, an optical recording medium or a semiconductor memory. More concretely, the recording unit 29 stores a channel map 29*a* representing, for example, channel information. More concretely, the channel map 29*a* includes, for example, virtual channel numbers assigned to the channel keys and the channel up/down key of the remote controller 40, physical channel numbers, direction information about directions in which the smart antenna 10 has directivity, and gain information about the gain of the smart antenna. The information included in the channel map 29*a* is determined and recorded in the channel map 29*a*, for example, by an initializing process for initializing the television receiving system 100.

The control unit 30 includes, for example, a CPU 30*a*, a RAM 30*b*, and a ROM 30*c*. The CPU 30*a* carries out control operations according to processing programs for the television receiver 20 stored in the ROM 30*c*. The RAM 30*b* has program storage areas in which the processing programs to be executed by the CPU 30*a* is developed, and data storage areas in which input data, and data obtained through the execution of the processing programs.

The ROM 30*c* stores a system program that can be executed by the television receiver 20, processing programs that can be executed by the system program, data needed for the execution of the processing programs, and data obtained through the arithmetic operations of the CPU 30*a*. The programs are stored in the ROM 30*c* in program codes that can be read by the computer. More concretely, the ROM 30*c* stores, for example, a transmission program 300 and such.

The transmission program 300 makes the CPU 30*a* exercise a function to transmit channel information through the 909 interface 21 to the smart antenna 10. More concretely, for example, when the user selects a desired channel by operating the channel key or the channel up/down key of the remote controller 40, the CPU 30*a* reads channel information including physical channel number, direction information and gain information and corresponding to the channel number of the selected channel (virtual channel number) from the channel map 29*a* of the recording unit 29. The CPU 30*a* sends the channel information through the 909 interface 21 to the antenna controller 11 of the smart antenna 10. Then, the smart antenna 10 changes directivity to receive broadcast television signals on the selected channel.

(1-2-1) Antenna Fixing Method

Figure 4:
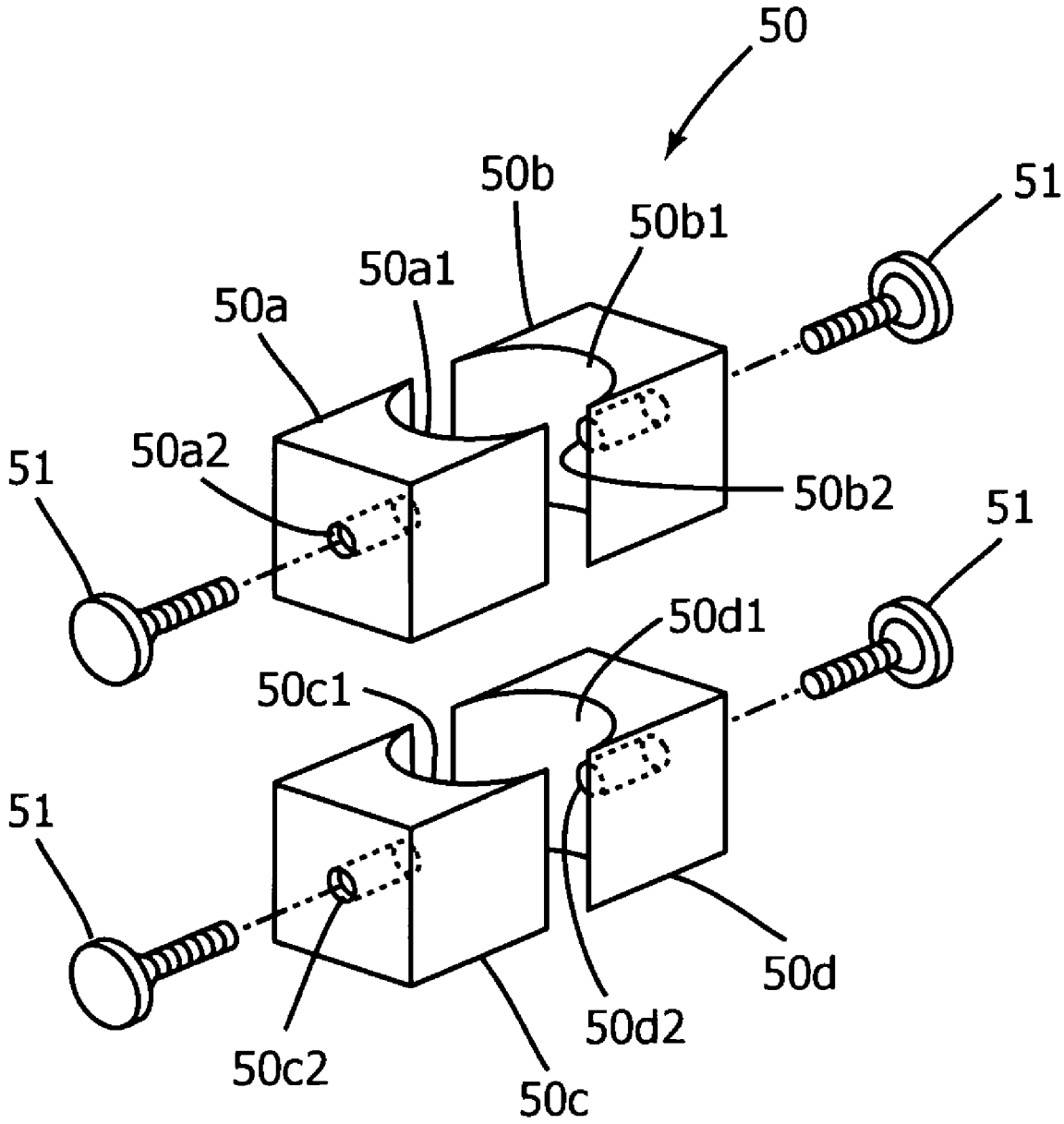
FIG. 4 is an exemplary perspective view of a holding part attached to the back wall of a cabinet.

FIG. 4 shows the holding part 50 formed on the back wall of the cabinet 20*a*. A method of fixedly holding the smart antenna 10 on the television receiver 20 by the holding part 50 will be described. Referring to FIG. 4, the holding part 50 includes four holding members 50*a*, 50*b*, 50*c* and 50*d* protruding from the outside surface of the back wall of the cabinet 20*a*. The holding members 50*a*, 50*b*, 50*c* and 50*d* hold the shaft 17 such that the top surface of the housing 14 of the smart antenna 10 is substantially parallel to a substantially horizontal surface on which the television receiver 20 is installed. The holding members 50*a* and 50*b* have opposite, concavely curved surfaces 50*a*1 and 50*b*1, respectively, and the holding members 50*c* and 50*d* have opposite, concavely curved surfaces 50*c*1 and 50*d*1, respectively. The concavely curved surfaces 50*a*1, 50*b*1, 50*c*1 and 50*d*1 are curved in a shape conforming to the outside surface of the shaft 17. The holding members 50*a*, 50*b*, 50*c* and 50*d* are provided with threaded holes 50*a*2, 50*b*2, 50*c*2 and 50*d*2, respectively. Screws 51 are screwed into the threaded holes 50*a*2, 50*b*2, 50*c*2 and 50*d*2.

Figure 5:
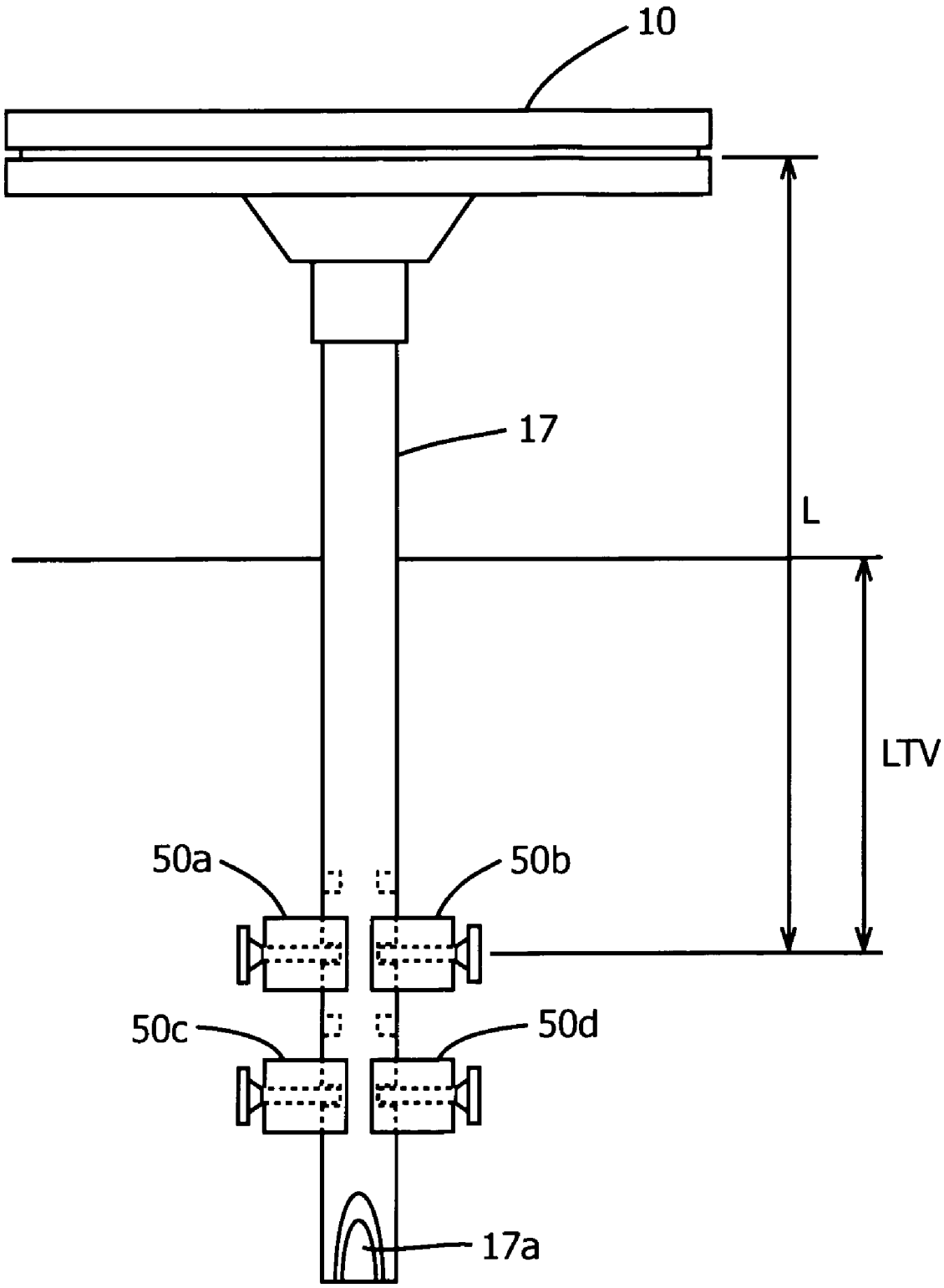
FIG. 5 is an exemplary view of assistance in explaining the height of a housing included in the smart antenna from the holding part.

FIG. 5 shows the height of the top surface and that of the housing 14 from the holding part 50. A lower end part of the shaft 17 opposite an upper end part of the same to which the housing 14 is attached is inserted down into a space defined by the respective curved surfaces 50*a*1 and 50*b*1 of the holding members 50*a* and 50*b*, and then the lower end part of the shaft 17 is penetrated down through a space defined by the respective curved surfaces 50*c*1 and 50*d*1 of the holding members 50*c* and 50*d*. Thus the shaft 17 is held between the respective curved surfaces 50*a*1 and 50*b*1 of the holding members 50*a* and 50*b* and between the respective curved surfaces 50*c*1 and 50*d*1 of the holding members 50*c* and 50*d*. Thus the top surface of the housing 14 attached to the upper end part of the shaft 17 is substantially parallel to the substantially horizontal surface on which the television receiver 20 is installed.

After the shaft 17 has been thus held between the respective curved surfaces 50*a*1 and 50*b*1 of the holding members 50*a* and 50*b* and between the respective curved surfaces 50*c*1 and 50*d*1 of the holding members 50*c* and 50*d*, the vertical position of the shaft 17 relative to the holding members 50*a* and 50*b* is adjusted such that the grooves 17*b* and 17*c* coincide with the threaded holes 50*a*2 and 50*b*2 of the holding members 50*a* and 50*b*, respectively. Then, the screws 51 are screwed into the threaded holes 50*a*2 and 50*b*2 so that the tips of the screws 51 are pressed against the bottom surfaces of the grooves 17*b* and 17*c* to hold the shaft 17 fixedly in place. Then, the screws 51 are screwed into the threaded holes 50*c*2 and 50*d*2 to hold the shaft 17 fixedly.

Then, the 909 cable 15*a*1 and the antenna RF cable 15*a*2 extending outside through the lower open end 17*a* of the shaft 17 are connected to the antenna terminals of the television receiver 20. Thus the smart antenna 10 is fixedly held on the television receiver 20 and the television receiver 20 can receive broadcast television signals.

The shaft 17 is provided with the plurality of grooves 17*b* and the plurality of grooves 17*c* to adjust the height of the top surface of the housing 14 of the smart antenna 10; that is, the height of the housing 14 relative to the television receiver 20 can be adjusted. Thus the influence of noise generated by the television receiver 20 on the antenna unit 15 contained in the housing 14 can be reduced.

In FIG. 5, the four grooves 17*b* and the four grooves 17*c* are formed laterally opposite to each other in four pairs each of the grooves 17*b* and 17*c*, and the screws 51 are pressed against the bottom surfaces of the second top pair of the grooves 17*b* and 17*c*. In this state, the height of the housing 14 of the smart antenna 10, such as the height of the receiving element 13 from the holding members 50*a* and 50*b* of the holding part 50 is L. The height of the top surface of the television receiver 20 from the holding part 50 is LTV.

More concretely, when the noise generated by the television receiver 20 influences the smart antenna 10, the screws 51 fastening the shaft 17 to the holding part 50 are loosened and the shaft 17 is raised to a desired height. For example, the shaft 17 is raided such that the fourth pair of the grooves 17*b* and 17*c* from the top coincide with the threaded holes 50*a*2 and 50*b*2 of the holding members 50*a* and 50*b*, respectively, and then the screws 51 are screwed into the threaded holes 50*a*2 and 50*b*2 so that the tips of the screws 51 are pressed against the bottom surfaces of the fourth pair of the grooves 17*b* and 17*c*, respectively. Thus the difference between the height L of the housing 14 from the holding part 50, and the height LTV of the top surface of the television receiver 20, namely, L-LTV, is increased to increase the distance between the housing 14 and the television receiver 20. Consequently, the effect of the noise generated by the television receiver 20 on the smart antenna 10 can be reduced. The distance between the housing 14 and the television receiver 20 can be reduced by moving the shaft 17 down relative to the holding part 50.

Figure 6:
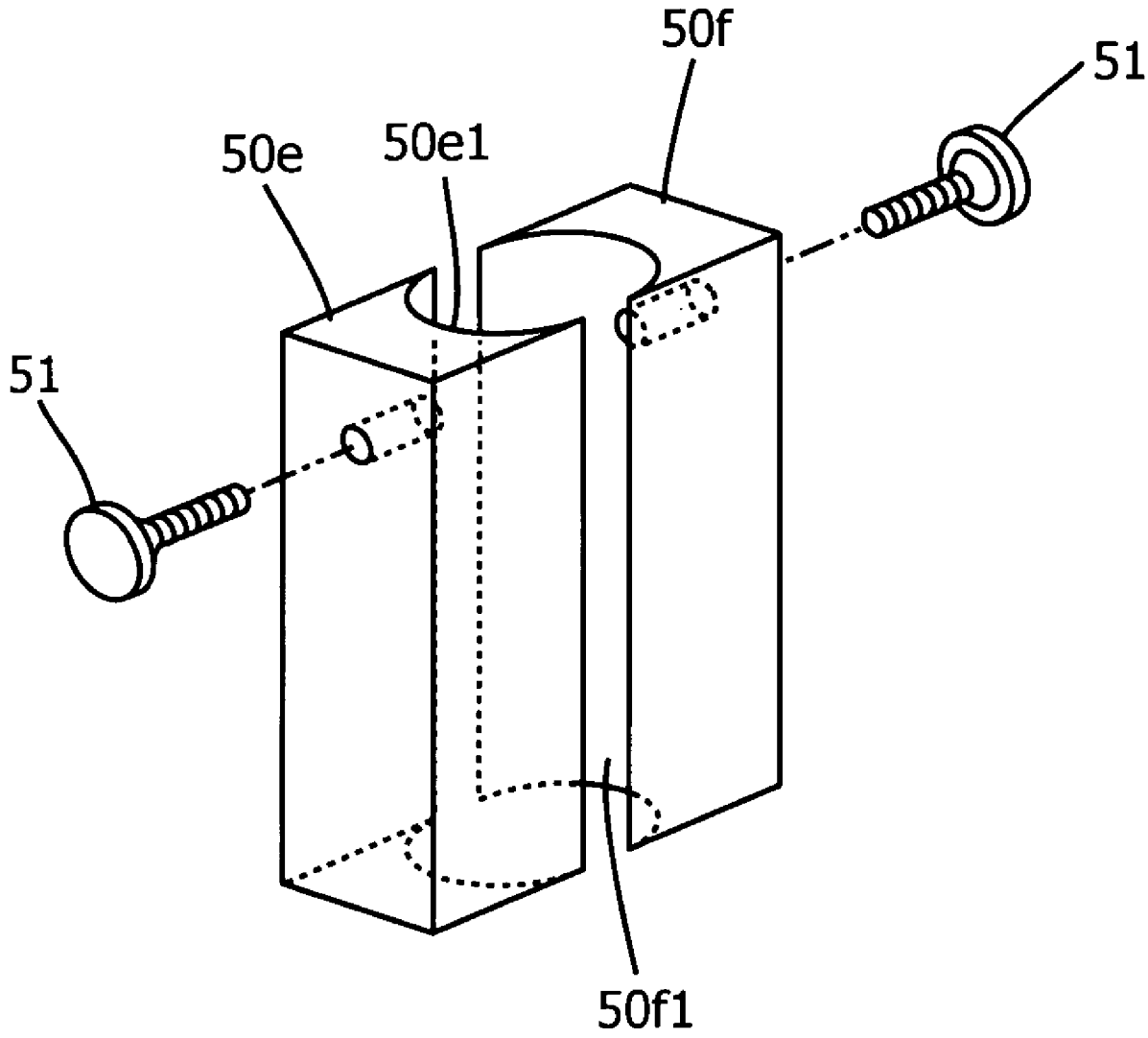
FIG. 6 is an exemplary perspective view of a holding part in a modification.
Figure 7:
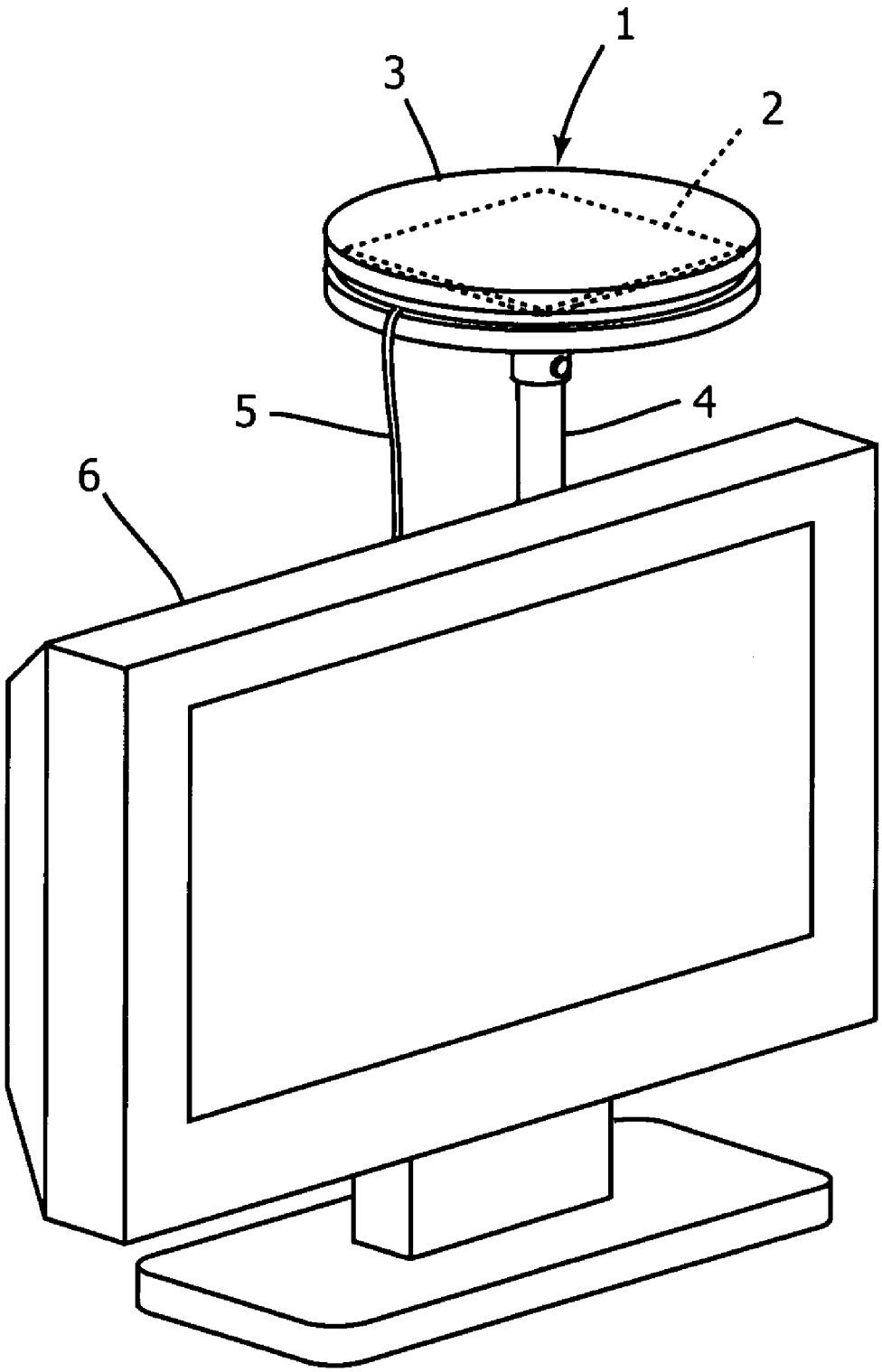
FIG. 7 is a perspective view of a known smart antenna mentioned in the description of the related art.

FIG. 6 shows a holding part 50 in a modification. The foregoing holding part 50 shown in FIG. 4 for holding the shaft 17 of the smart antenna 10 is only an example. The holding part 50 shown in FIG. 6 may be employed. Referring to FIG. 6, the holding part 50, similarly to the holding part 50 shown in FIG. 4, protrudes from the outside surface of the back wall of the cabinet 20*a* of the television receiver 20. The holding part 50 has a pair of holding members 50*e* and 50*f* protruding from the outside surface of the back wall of the cabinet 20*a*. The holding members 50*e* and 50*f* has a vertical length longer than that of the holding members 50*a* and 50*b* shown in FIG. 4. The lower end part of the shaft 17 is fitted in a space defined by the respective concavely curved surfaces 50*e*1 and 50*f*1 of the holding members 50*e* and 50*f*.

(2) Conclusion

The television receiver 20 fixedly holds the shaft 17 of the smart antenna 10 by the holding part 50 protruding from the outside surface of the back wall of the cabinet 20*a*. The 909 cable 15*a*1 and the antenna RF cable 15*a*2 extending outside from the support tube 17 through the lower open end 17*a* distant from the holding part 50 are connected to the television receiver 20. Since the 909 cable 15*a*1 and the antenna RF cable 15*a*2 extend outside from the support tube 17 through the lower open end 17*a* apart from a part of the support tube 17 held by the holding part 50, the 909 cable 15*a*1 and the antenna RF cable 15*a*2 can be connected and extended to the television receiver 20 without being obstructed by the holding part 50; that is the 909 cable 15*a*1 and the antenna RF cable 15*a*2 can be extended through the lower open end 17*a* and connected to the television receiver 20 without being interfered with by the holding part 50, and the screws 51 made of a conductive material and included in the holding part 50. Thus the 909 cable 15*a*1 and the antenna RF cable 15*a*2 can be connected to the television receiver 20 without spoiling the appearance of the combination of the smart antenna 10 and the television receiver 20. The 909 cable 15*a*1 and the antenna RF cable 15*a*2 covered with the shaft 17 will not be broken.

The smart antenna of the present invention has the housing and the shaft. The housing has a flat cylindrical configuration, and holds the antenna unit therein so that the receiving element is set approximately in a horizontal orientation. The smart antenna is highly sensitive to signals owing to its own properties and is susceptible to the influence of conductive objects. Therefore, the shaft supports the housing at a predetermined distance from the television receiver to reduce the influence of noise generated by the television receiver. The shaft having the shape of a tube guides the wiring extended from the antenna unit to the television receiver. The wiring extended from the antenna unit are extended through the shaft to the television receiver and are connected to the television receiver. Thus the wiring are concealed from view and hence the smart antenna has an aesthetically satisfactory appearance. Since the wiring are extended through the shaft to the television receiver, the wiring extended from the antenna unit are prevented from breakage. The wiring are arranged neatly and the directional smart antenna is aesthetically excellent in appearance, the wiring are prevented from breakage.

In another embodiment of the present invention, the wiring are a 909 cable for controlling the receiving element, and an antenna RF cable for transmitting received television signals to the television receiver. The present invention is applicable to smart antennas using the foregoing two types of wiring.

The construction of the television receiver, as well as that of the smart antenna, needs to be taken into consideration in determining the arrangement of the wiring of the smart antenna. In an antenna fixing mechanism in another embodiment according to the present invention for fixing a smart antenna having electrically changeable directivity on a television receiver, an antenna unit includes a receiving element set to receive broadcast television signals transmitted from a plurality of directions, and that is capable of selectively providing the broadcast television signals received by the receiving element, a housing of flat cylindrical configuration, which holds the antenna unit therein so that the receiving element is set up to near-horizontal orientation, wiring that electrically connects the antenna unit to a television receiver, a hollow shaft on the television receiver supports the housing at a predetermined distance from the television receiver, and holds the wiring therein, an holding part holds the shaft fixedly on the television receiver, the shaft is provided with an opening in another part thereof distant from a part thereof held by the holding part, and the wiring are extended outside from the shaft through the opening, and are connected to the television receiver.

The smart antenna is held fixedly on the television receiver by the holding part. Since the wiring are extended outside from the shaft through the opening formed in the part of the shaft at a distance from the part held by the holding part, the wiring can be connected to the television receiver without being obstructed by the holding part. The wiring extending outside through the opening can be connected to the television receiver without interfering with the holding part and screws made of a conductive material and included in the holding part. Thus the wiring are prevented from breakage, and the smart antenna can be securely held on the television receiver.

As mentioned above, the wiring are extended outside from the shaft through the opening formed in the part of the shaft at a distance from the part held by the holding part. Therefore, it is desirable that the holding part has a shape that will not interfere with the opening of the shaft. In another embodiment of the present invention, an holding part for securely holding the smart antenna includes holding members for holding the shaft between them protruding from the television receiver and defining a space through which the shaft is extended, and screws for fixing the shaft extended through the space between the holding members to the holding part.

According to the present invention, the shaft of the smart antenna is held between the holding members and is held fixedly on the holding members with the screws screwed into the threaded holes of the holding members and having tips pressed against the shaft. Since the shaft is simply held between the holding members, the shaft can be fixed without covering the opening formed therein. When a part of the shaft is held between the holding members, the opening can be formed in a part of the shaft other than the part held between the holding members so that the wiring can be extended outside from the shaft through the opening without being obstructed by the holding members. Since the part of the shaft held between the holding members is fixed to the holding members with the screws, the wiring extending outside from the shaft do not come into direct contact with metallic members, such as the screws. Thus the connecting wiring are not broken by the holding part when the smart antenna is held fixedly by the holding part, the shaft can be turned about is axis, and hence the wiring can be optionally arranged.

In another embodiment of the present invention, the shaft is provided with grooves in which the screws are engaged in a longitudinal direction, and the housing supported on an upper end part of the shaft is held at a predetermined height by engaging the screws screwed into the threaded holes in the grooves. Thus the shaft is attached to the television receiver.

The height of the housing attached to the upper end part of the shaft from the holding part can be changed by adjusting the positions of parts of the grooves where the screws are engaged in the grooves. Thus the vertical position of the housing can be optionally changed, and the height of the smart antenna from the top surface of the television receiver can be optionally adjusted. Consequently, the influence of noise generated by the television receiver on the smart antenna can be reduced to improve the receiving sensitivity of the smart antenna.

The present invention can be embodied in an antenna fixing mechanism in another embodiment. In an antenna fixing mechanism in another embodiment for fixing a smart antenna having electrically changeable directivity for receiving electromagnetic wave on a television receiver, an antenna unit includes a receiving element set to receive broadcast television signals transmitted from a plurality of directions, and that is capable of selectively providing the broadcast television signals received by the receiving element, a housing with flat cylindrical configuration holds the antenna unit therein so that the receiving element is set near-horizontal orientation, wiring include an antenna RF cable for transmitting broadcast television signals provided by the antenna unit to the television receiver, and a 909 cable based on a predetermined communication system for controlling the receiving element, a hollow hollow shaft made of an insulating material, have one end part connected to a lower part of the housing, holds the wiring extended from the antenna unit therein, and is provided with a plurality of grooves in a longitudinal direction in another end part thereof that is not connected to the housing, and a holding part includes holding members protruding from the television receiver so that the shaft can be held between the holding members, and screws screwed into threaded holes formed in the holding members to fix the shaft. The shaft is held fixedly on the television receiver so that a vertical position thereof is adjustable by engaging end parts of the screws screwed into the threaded holes in the grooves, and is provided with an opening in another part thereof distant from a part thereof held by the holding part. And the wiring extended through the shaft are extended outside from the shaft through the opening, and are connected to the television receiver.

Although the present invention has been described in its preferred embodiments with reference to the accompanying drawings, those embodiments are only examples and many changes and improvements can be made therein by the knowledge of those skilled in the art.

While the invention has been particularly shown and described with respect to preferred embodiments thereof, it should be understood by those skilled in the art that the foregoing and other changes in form and detail may be made therein without departing from the spirit and scope of the invention as defined in the appended claims.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

What is claimed is:

1. An antenna fixing mechanism, comprising:

an antenna unit that includes a receiving element for receiving broadcast television signals transmitted from a plurality of directions, with the antenna unit having wiring that electrically couple and transmit signals from the antenna unit to a television receiver;

a housing of flat cylindrical configuration having an upper half and a lower half, with the lower half having a first aperture at a radial center of the lower half;

the housing accommodates the antenna unit, with the receiving element of the antenna unit housed and maintained in a substantially horizontal orientation within the housing;

a hollow shaft that has a first end and a second end; the first end of the hollow shaft is coupled with the lower half of the housing through a connecting member;

the connecting member includes a bore with a central longitudinal axis that coincides and is concentric with the first aperture and a hollow section of the hollow shaft;

the wiring of the antenna unit extends out through the first aperture of the lower half of the housing, passes through the bore of the connecting member and out and into the hollow shaft through the first end, and exists out of the second end of the hollow shaft, and is coupled with the television receiver;

the hollow shaft includes a plurality of grooves near the second end, aligned along a longitudinal direction of the hollow shaft, with each groove of the plurality of grooves oriented transversely in relation to the longitudinal direction of the hollow shaft, and axially aligned diametrically with respect to one another;

the plurality of grooves are used to adjustably fix and maintain an appropriate distance between the housing with which the hollow shaft is coupled and the television receiver to reduce interference noise signal from the television receiver that may affect reception quality of the antenna unit;

a holding part that adjustably holds the hollow shaft on the television receiver so that the housing is maintained substantially horizontally, parallel in relation to a horizontal surface on which the television receiver is maintained;

the holding part includes holding members protruding from an outside surface of a back wall of a cabinet of the television receiver so that the hollow shaft is held between the holding members and on the television receiver;

the holding members include opposite, concavely curved surfaces that face each other, and are substantially configured to an outside surface of the hollow shaft;

the holding members further include threaded through-holes through the concavely curved surfaces of the holding members, with one or more of the diametrically opposed groove of the hollow shaft aligned to coincide with the threaded through-holes of the holding members; and with a set of fasteners inserted through the threaded through-holes of the holding member and the aligned one or more diametrically opposed groove to adjustably fix and maintain the hollow shaft in a position that provides appropriate distance between the housing and the television receiver for optimal reception of broadcast television signals.

2. The antenna fixing mechanism as set forth in claim 1, wherein:

the first end of the hollow shaft is inserted into the bore of the connecting member, and detachably secured therein by a fastener inserted through a connecting hole of the connecting member that is oriented normal the bore.

3. The antenna fixing mechanism as set forth in claim 1, wherein:

the connecting member is protruded from the lower half of the housing, and is substantially configured as an inverted frustum.

4. An antenna fixing mechanism for a smart antenna, comprising:

an antenna unit that includes a receiving element for receiving broadcast television signals transmitted from a plurality of directions, with the antenna unit having wiring that electrically couple and transmit signals from the antenna unit to a television receiver;

the wiring includes an antenna Radio Frequency (RF) cable for transmitting broadcast television signals provided by the antenna unit to the television receiver, and a cable based on a predetermined communication system for controlling the receiving element;

a housing of flat cylindrical configuration having an upper half and a lower half, with the lower half having a first aperture at a radial center of the lower half;

the housing accommodates the antenna unit, with the receiving element of the antenna unit housed and maintained in a substantially horizontal orientation within the housing;

a hollow shaft made of an insulating material that has a first end and a second end;

the first end of the hollow shaft is coupled with the lower half of the housing through a connecting member;

the connecting member includes a bore with a central longitudinal axis that coincides and is concentric with the first aperture and a hollow section of the hollow shaft;

the wiring of the antenna unit extends out through the first aperture of the lower half of the housing, passes through the bore of the connecting member and out and into the hollow shaft through the first end, and exists out of the second end of the hollow shaft, and is coupled with the television receiver;

the hollow shaft includes a plurality of grooves near the second end, aligned along a longitudinal direction of the hollow shaft, with each groove of the plurality of grooves oriented transversely in relation to the longitudinal direction of the hollow shaft, and axially aligned diametrically with respect to one another;

the plurality of grooves are used to adjustably fix and maintain an appropriate distance between the housing with which the hollow shaft is coupled and the television receiver to reduce interference noise signal from the television receiver that may affect reception quality of the antenna unit;

a holding part that adjustably holds the hollow shaft on the television receiver so that the housing is maintained substantially horizontally, parallel in relation to a horizontal surface on which the television receiver is maintained;

the holding part includes holding members protruding from an outside surface of a back wall of a cabinet of the television receiver so that the hollow shaft is held between the holding members and on the television receiver;

the holding members include opposite, concavely curved surfaces that face each other, and are substantially configured to an outside surface of the hollow shaft;

the holding members further include threaded through-holes through the concavely curved surfaces of the holding members, with one or more of the diametrically opposed groove of the hollow shaft aligned to coincide with the threaded through-holes of the holding members; and with a set of fasteners inserted through the threaded through-holes of the holding member and the aligned one or more diametrically opposed groove to adjustably fix and maintain the hollow shaft in a position that provides appropriate distance between the housing and the television receiver for optimal reception of broadcast television signals;

the hollow shaft is held fixedly on the television receiver so that a vertical position thereof is adjustable by engaging end parts of the fasteners into the threaded through-holes and in the one or more groove.

5. The antenna fixing mechanism for a smart antenna as set forth in claim 4 wherein:

the first end of the hollow shaft is inserted into the bore of the connecting member, and detachably secured therein by a fastener inserted through a connecting hole of the connecting member that is oriented normal the bore.

6. The antenna fixing mechanism for a smart antenna as set forth in claim 4 wherein:

the connecting member is protruded from the lower half of the housing, and is substantially configured as an inverted frustum.

* * * * *